US006447429B1

(12) United States Patent
Chen et al.

(10) Patent No.: US 6,447,429 B1
(45) Date of Patent: Sep. 10, 2002

(54) BODY WEIGHT DRIVEN TREADMILL

(76) Inventors: Shu-Yi Chen, No. 733, Sec. 4, Yen Hai Road, Fu Hsing Hsiang, Chang Hua Hsien (TW); Wan-Chen Hsieh, 6F-1, No. 100, Sec. 2, Lin Sen Road, East Area, Tainan City (TW)

( * ) Notice: Subject to any disclaimer, the term of this patent is extended or adjusted under 35 U.S.C. 154(b) by 0 days.

(21) Appl. No.: 09/978,037

(22) Filed: Oct. 17, 2001

(51) Int. Cl.[7] ..... A63B 23/08; A63B 23/10
(52) U.S. Cl. ..... 482/79; 482/80
(58) Field of Search ..... 482/79–80, 77, 482/142

(56) References Cited

U.S. PATENT DOCUMENTS

| | | | | | |
|---|---|---|---|---|---|
| 2,820,454 | A | * | 1/1958 | Wright | 128/25 |
| 5,125,880 | A | * | 6/1992 | Peters | 482/68 |
| 5,205,798 | A | * | 4/1993 | Lekhtman | 482/77 |
| 5,304,106 | A | * | 4/1994 | Gresko | 482/53 |
| 5,328,421 | A | * | 7/1994 | Stanalajczo | 482/34 |
| 5,643,148 | A | * | 7/1997 | Naville | 482/77 |
| 5,713,820 | A | * | 2/1998 | Carbone | 482/79 |
| 5,871,298 | A | * | 2/1999 | Lekhtman et al. | 402/77 |
| 5,897,464 | A | * | 4/1999 | Mcleod | 482/79 |
| 5,916,071 | A | * | 6/1999 | Lee | 482/77 |
| 6,318,001 | B1 | * | 11/2001 | Lee | 36/27 |

* cited by examiner

*Primary Examiner*—Michael A. Brown
*Assistant Examiner*—Lori Baker Amerson
(74) *Attorney, Agent, or Firm*—Troxell Law Office PLLC

(57) ABSTRACT

The present invention relates to a body weight driven treadmill, and when the exerciser steps on the treadmill, the exerciser's body weight acts as a loading to tilt the pedal platform upward from the rear back of the treadmill, since the base of the treadmill has a front supporting rod and a rear supporting rod, wherein the radius of the front supporting rod is slightly smaller than that of the rear supporting rod, and the points of contact tangential to the ground are different. Such arrangement can slightly tilt the exerciser's body forward, until it reaches equilibrium and a stable position. When the treadmill is stepped by our legs alternately, the pressing foot will tilt forward, and twist the exerciser's waist. Such body weight driven treadmill is a simple and easy-to-assemble structure and does not occupy much space.

4 Claims, 7 Drawing Sheets

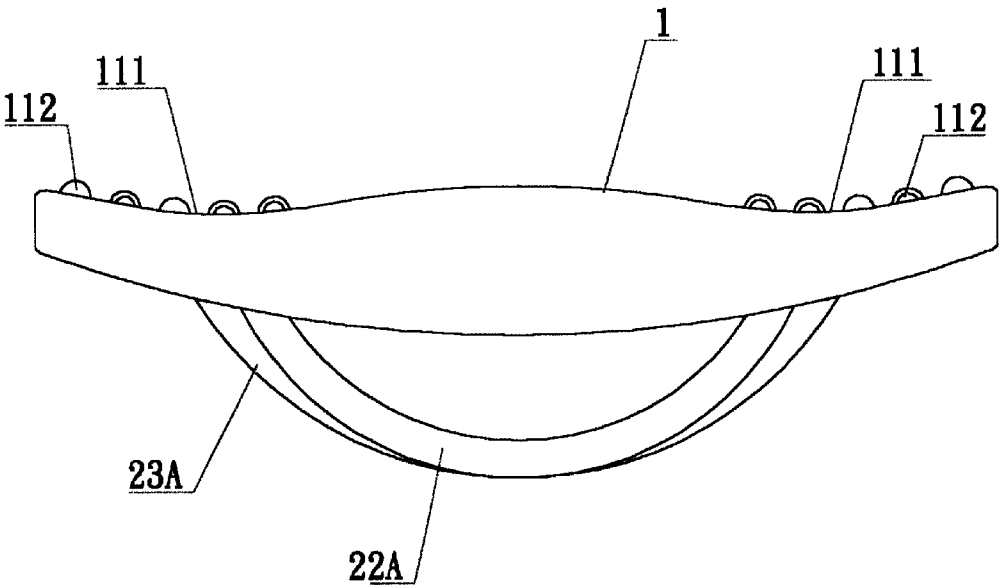
FIG3-B
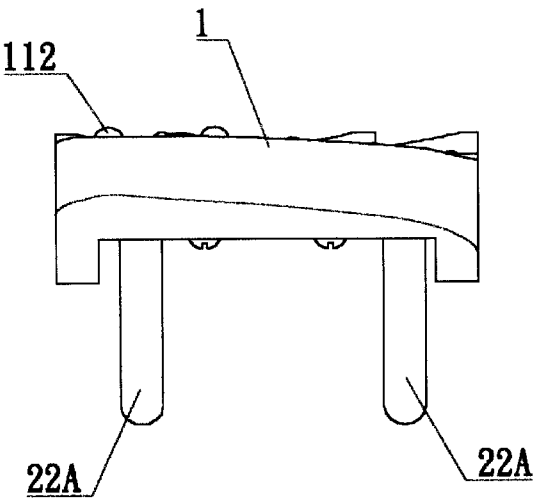
FIG3-A

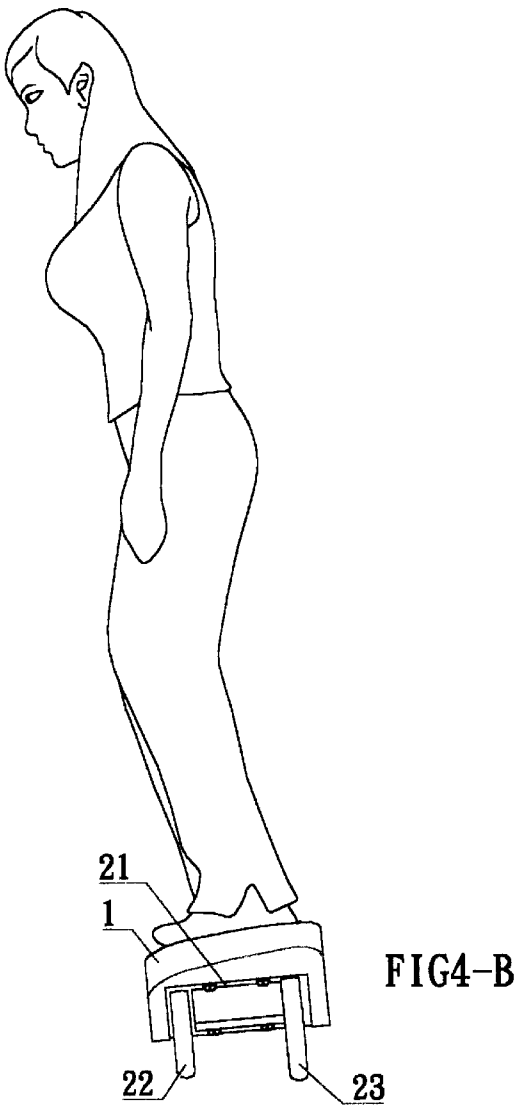
FIG4-B
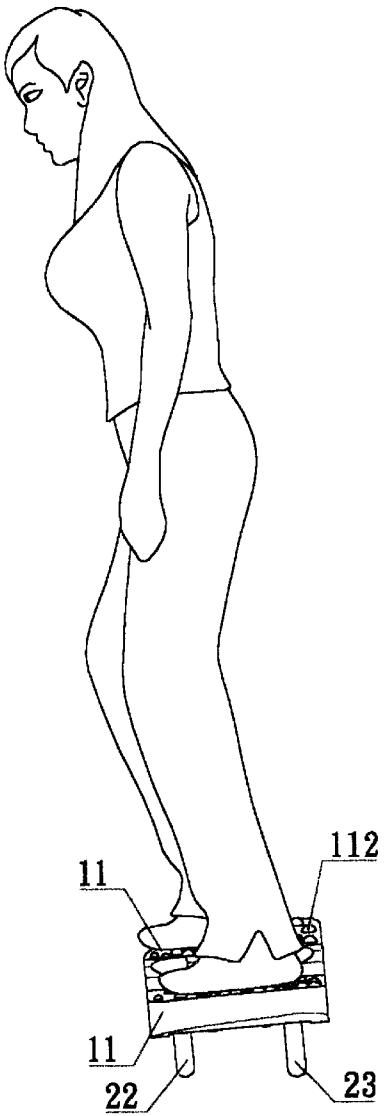
FIG4-A

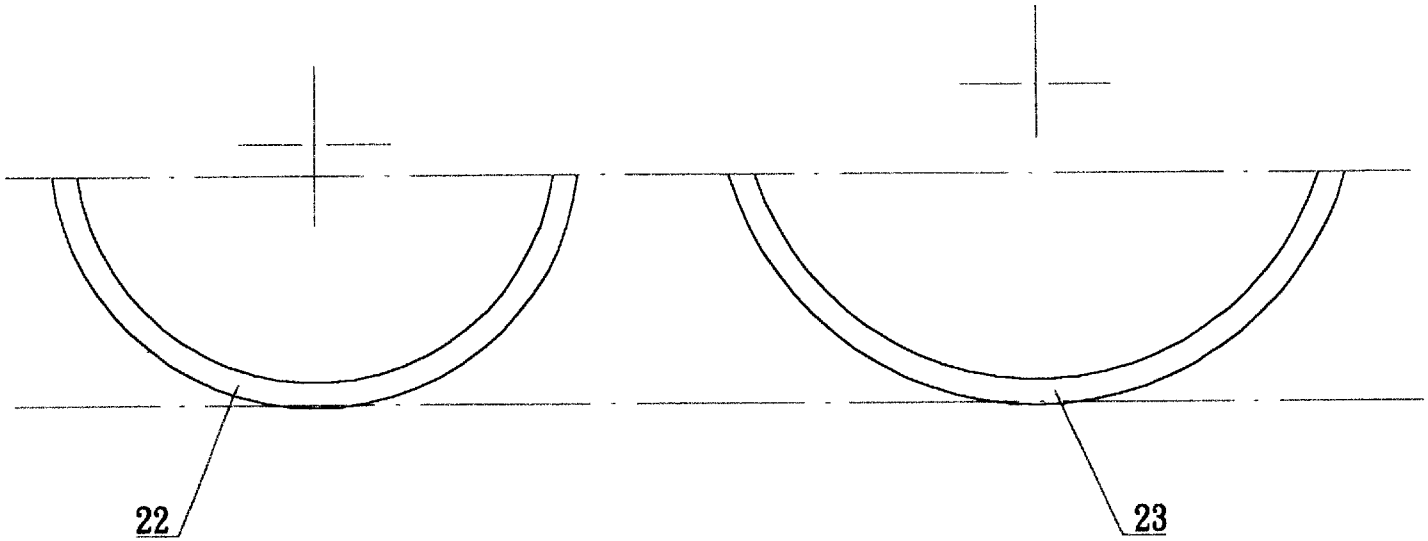
FIG5-A
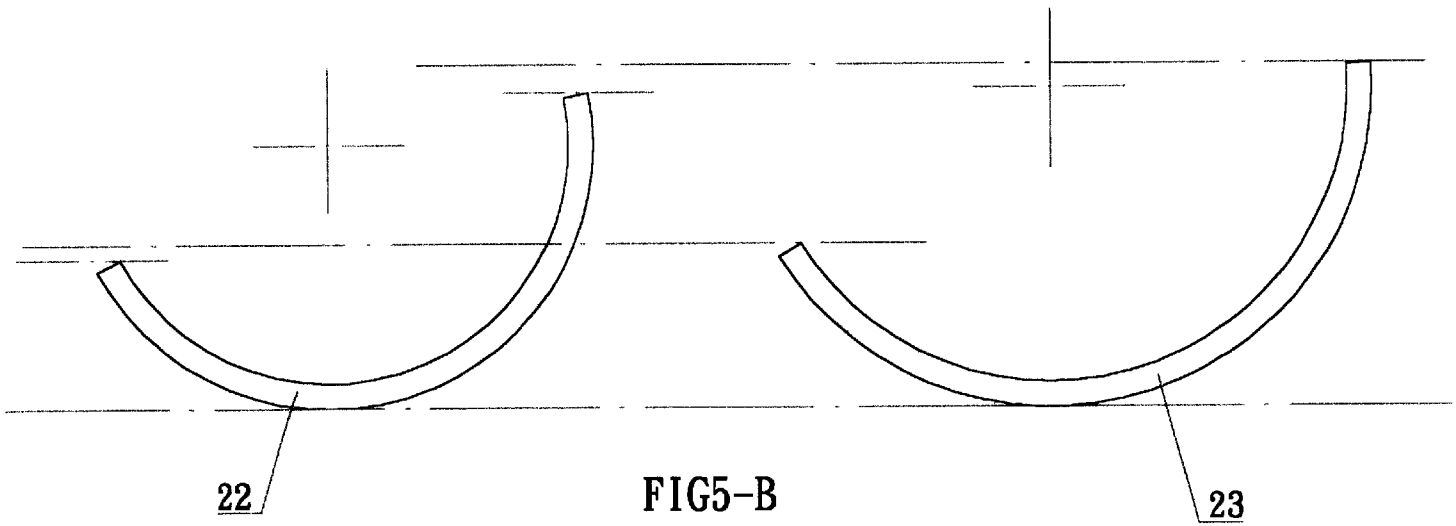
FIG5-B

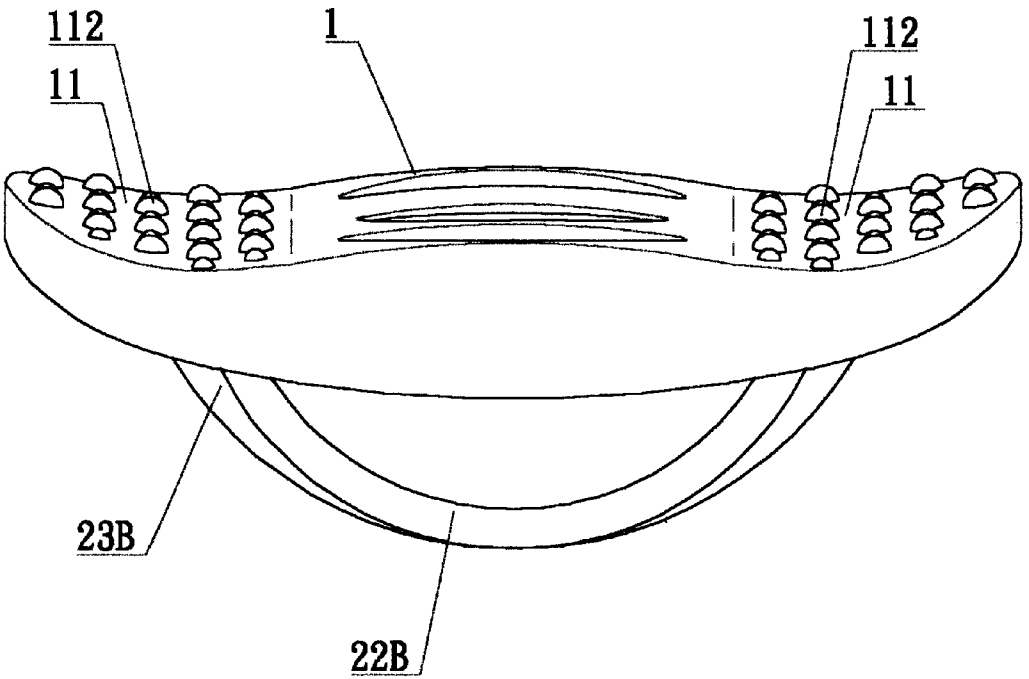
FIG6-B
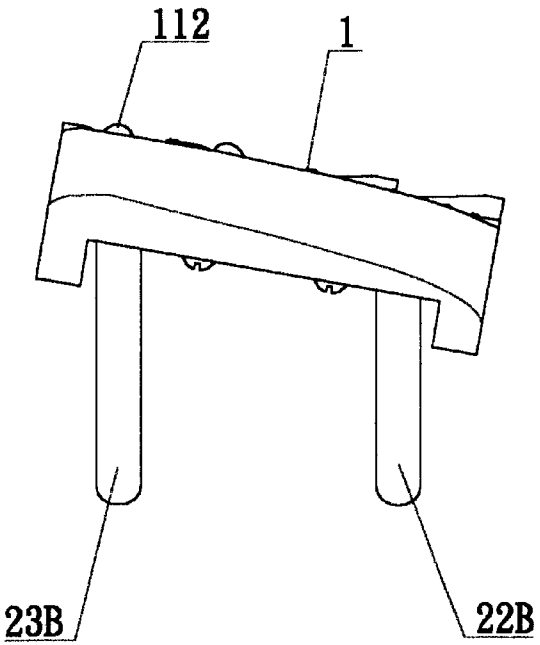
FIG6-A

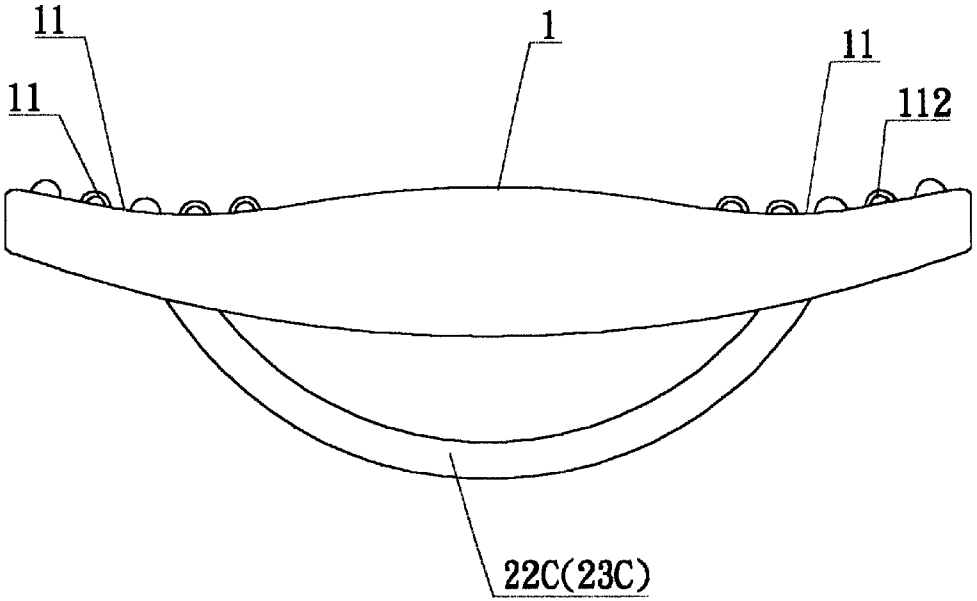
FIG7-B
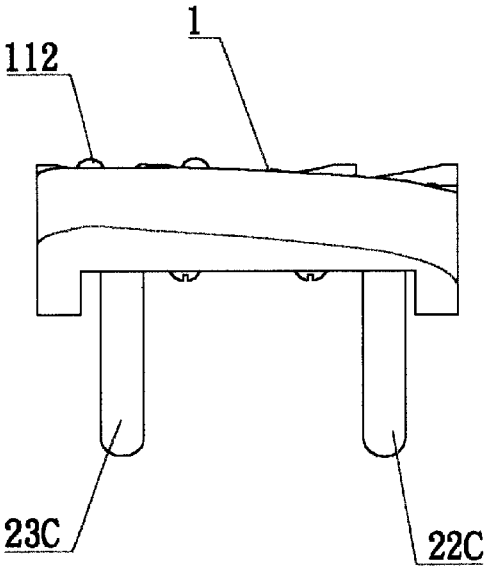
FIG7-A

BODY WEIGHT DRIVEN TREADMILL

BACKGROUND OF THE INVENTION

1. Field of the Invention

The present invention relates to a body weight driven treadmill for training the leg and waist of the exerciser, comprising a pedal platform for the exerciser to step on, and a base being fixed to the bottom of the pedal platform, and a front supporting rod and a rear supporting rod being disposed at the front end and the rear end of the pedal platform respectively, and the radius of the front supporting rod is slightly smaller than that of the rear supporting rod, and each of the contact points of the front supporting rod and the rear supporting rod tangential to the ground acts as the fulcrum to move in equilibrium in a movement unlike the seesaw. When the exercise steps on the pedal platform, the body weight of the exerciser acts as a loading and slightly tilts the exerciser's body forward until it reaches equilibrium and a stable position. When the treadmill is stepped by the exerciser's legs alternately, the pressing foot will tilt forward, and twist the exerciser's waist. Such body weight driven treadmill is a simple and easy-to-assemble structure and does not occupy much space.

2. Description of the Related Art

As the time progresses, our life quality is getting better. People are paying more attention to exercises and leisure activities even in an environment of busy work. The traditional treadmills in the market are generally those being installed onto the ground with a conveyor-belt platform and a standing handle being fixed vertically in front of the platform. When the exerciser steps on the platform, the foot will bring the conveyor-belt platform to rotate at an original position in order to have exercise effect for the exerciser. However, such treadmill can only provide exercise to the foot (for the walking), and is unable to have other exercise functions. It greatly reduces the practicability of such fitness equipment.

SUMMARY OF THE INVENTION

The primary objective of the present invention is to provide a body weight driven treadmill having a front supporting rod and a rear supporting rod disposed at the front end and the rear end of the pedal platform respectively, and the radius of the front supporting rod is slightly smaller than that of the rear supporting rod, and each of the contact points of the front supporting rod and the rear supporting rod tangential to the ground acts as the fulcrum for a movement unlike a seesaw. Such arrangement can slightly tilt the exerciser's body forward, until it reaches equilibrium and a stable position. Such body weight driven treadmill is a simple and easy-to-assemble structure and does not occupy much space.

Another objective of the present invention is to provide a body weight driven treadmill that uses the exerciser's body weight as the loading and the alternate stepping on the treadmill to twist the exerciser's waist when one of the feet is stepped on the treadmill and brings it forward. Such arrangement has exercise effect on the feet as well as the waist.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which:

FIG. 3A is a front-view diagram showing the pedal platform of the present invention in horizontal position.

FIG. 3B is a side-view diagram showing the pedal platform of the present invention in horizontal position.

FIG. 4A shows the exerciser steps with his/her left foot according to a preferred embodiment of the present invention.

FIG. 4B shows the exerciser steps with his/her right foot according to a preferred embodiment of the present invention.

FIG. 5A shows the separate movement of the front supporting rod and the rear supporting rod according to a preferred embodiment of the present invention (I).

FIG. 5B shows the separate movement of the front supporting rod and the rear supporting rod according to a preferred embodiment of the present invention (II).

FIG. 6A is a front-view diagram showing the tilted pedal platform of the present invention.

FIG. 6B is a side-view diagram showing the tilted pedal platform of the present invention.

FIG. 7A is a front-view diagram showing the coaxial and concentric front supporting rod and rear supporting rod of the present invention.

FIG. 7B is a side-view diagram showing the coaxial and concentric front supporting rod and rear supporting rod of the present invention.

DETAILED DESCRIPTION OF THE PREFERRED EMBODIMENTS

Figure 1:
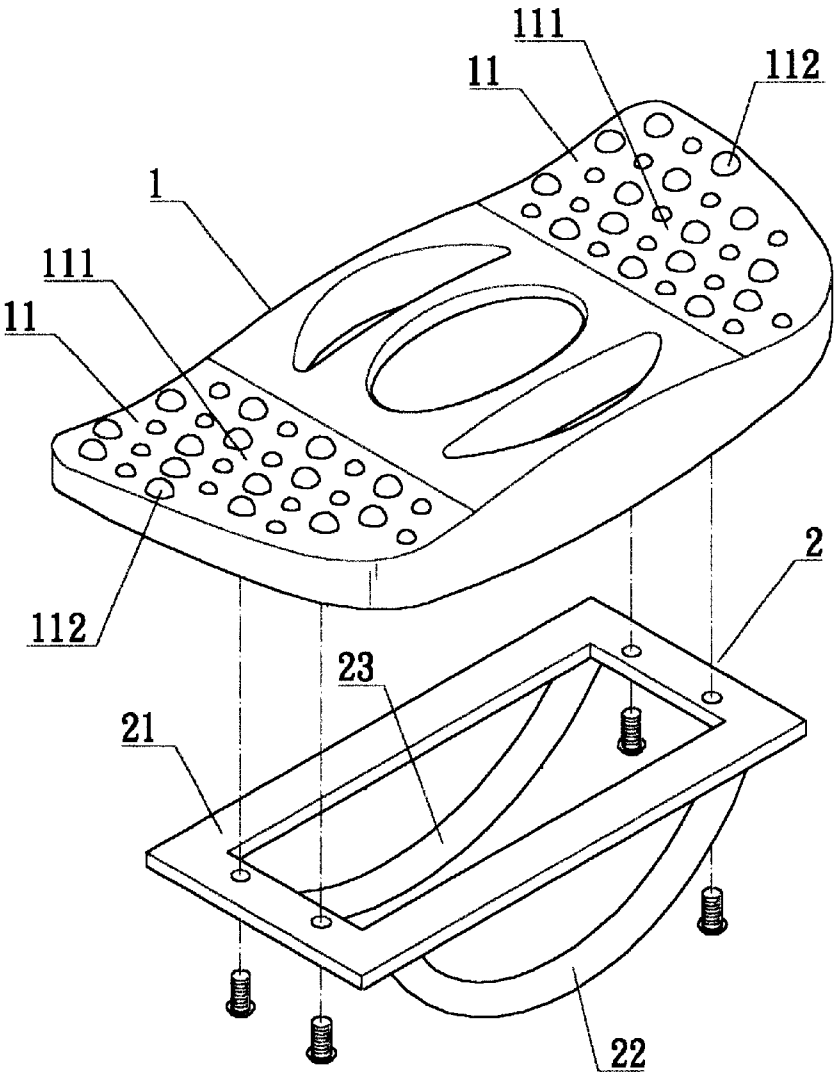
FIG. 1 is the three-dimensional diagram showing the disassembled structure of the present invention.
Figure 2:
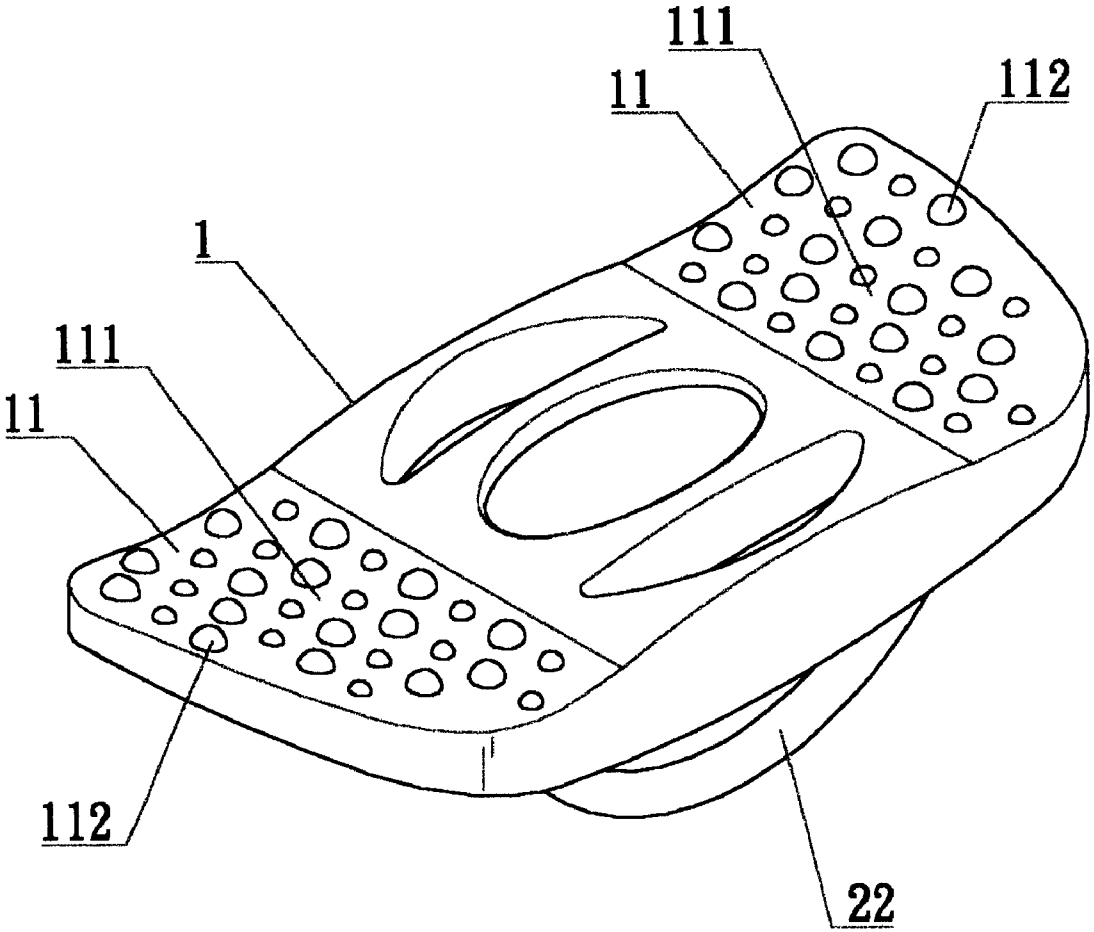
FIG. 2 is the three-dimensional diagram of the assembled structure of the present invention.

Please refer to FIG. 1 and FIG. 2 in which the structure of the present invention is clearly shown. The body weight driven treadmill comprises a pedal platform 1 for the exerciser to step on, and a base 2 for moving the pedal platform back and forth; wherein both ends of the pedal platform having a pedal 11 with a depression 111 for accommodating the sole of the foot, and the depression 111 will perfectly attach onto the sole of the foot, and a plurality of protruded granule 112 being disposed on the pedal 11 for the stepping by the sole of the foot as well as having the function of massaging the foot.

The base 2 comprises a transversal rack rod 21 being locked to the bottom of the pedal platform 1, a front supporting rod 22 and a rear supporting rod 23 being disposed at the bottom surface of the front end and rear end of the transversal rack rod 21 respectively, and both of the front supporting rod 22 and the rear supporting rod 23 are in semispherical shape and it is a rod structure being attached onto the rod. The radius of the front supporting rod 22 is slightly smaller than that of the rear support rod 23, and the contact points tangential to the ground and the front supporting rod 22 and the rear supporting rod 23 are different. The setting of the front supporting rod 22 and the rear supporting rod 23 could be in the following two kinds:

The first kind comprises a front supporting rod 22A and a rear supporting rod 23A of the base 2 having different radii and axes and both ends of the top of the front supporting rod 22A with a smaller radius further comprising an extended section 221 being extended vertically upward. The extended section 221 and both ends of the top of the rear supporting rod 23 are of equal heights such that when the pedal platform 1 is raised, the pedal platform 1 will be in horizontal position as shown in FIG. 3).

The second kind comprises a front supporting rod 22B and a rear supporting rod 23B of the base 2 having different radii and axes such that both ends of the top of the front supporting rod 22B and the rear supporting rod 23B are of different heights. When the pedal platform 1 is raised, the pedal platform 1 will tilt downward at the front end as shown in FIG. 6.

Please refer to FIG. 4 and FIG. 6 for the installation and movement. When the exerciser steps on the pedal platform 1, the base 2 will use the semispherical rod of the front supporting rod 22 and the rear supporting rod 23 and the contact points at each tangential position with the ground as the fulcrum to move the treadmill in equilibrium unlike the movement of the seesaw. When the exerciser steps both feet on the pedal platform 1, the exerciser will move according to the up and down movement of the pedal 11. Since the radius of the front supporting rod 22 is slightly smaller than that of the rear supporting rod 23, therefore the tangential points of the front supporting rod 22 and the rear supporting rod 23 with the ground are different. When the pedal platform 1 is pressed down, it will tilt forward, and the exerciser's body will naturally tilt forward slightly in order to set the front supporting rod 22 and the rear supporting rod 23 in equilibrium and a stable position (as shown in FIG. 5). By having the radius of the front supporting rod 22 slightly larger than that of the rear supporting rod 23, the exerciser may have the exercise effect on the waist since the pressing of one foot will tilt the pedal forward when the exerciser steps his/her feet alternately on the pedal platform.

By stepping on the body weight driven treadmill, the exerciser uses his/her body weight as the loading with the structure having a radius of the front supporting rod 22 larger than that of the rear supporting rod 23 to get a stepping exercise while there is an exercise effect on the waist as well. Such body weight driven treadmill is a simple and easy-to-assemble structure and does not occupy much space.

Please refer to FIG. 7. The front supporting rod 22 and the rear supporting rod 23 is of equal radius, and the same axis, such that when the pedal platform is raised, it will be in a horizontal position. The treadmill structure will provide the exerciser an exercise purely on the feet when the user just steps on the treadmill.

In summation of the above description, the present invention herein enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A body weight driven treadmill comprising: a pedal platform for an exerciser to step on, and a base being fixed to a bottom of the pedal platform for its back and forth movement; wherein the base includes a transversal rack rod coupled to the bottom of the pedal platform, a front supporting rod and a rear supporting rod disposed at a front end and a rear end of a bottom surface of the transversal rack rod respectively, a radius of the front supporting rod being smaller than a radius of the rear supporting rod, whereby contact points of the front supporting rod and the rear supporting rod with a support surface are different from each other whereby a user may exercise feet as well as a waist, wherein the front supporting rod and the rear supporting rod have different axes and different radii such that top ends of the front supporting rod and rear supporting rod are of different heights, such that, the pedal platform will tilt downward at the front.

2. The body weight driven treadmill as claimed in claim 1, wherein said pedal platform has a depression on each side thereof to provide a place to accommodate a sole of a user's foot.

3. The body weight driven treadmill as claimed in claim 1, wherein said front supporting rod with the smaller radius has an extended section vertically extending upwardly from top ends such that the extended section and a top of the rear supporting rod are of the equal height so that when the pedal platform is raised, the pedal platform is in a horizontal position.

4. The body weight driven treadmill as claimed in claim 2, wherein said pedal platform has a plurality of protruding granules thereon to have a massaging effect to a user's feet.

* * * * *